US005860492A

United States Patent [19]

Talaska

[11] Patent Number: 5,860,492

[45] Date of Patent: Jan. 19, 1999

[54] HAND-ACTIVATED BRAKE AND METHOD

[75] Inventor: Eric C. Talaska, Ashdown, Ark.

[73] Assignee: Controlit, Inc., Wilmington, Del.

[21] Appl. No.: 639,683

[22] Filed: Apr. 29, 1996

[51] Int. Cl.[6] ..... B60T 1/14

[52] U.S. Cl. ..... 188/5; 280/112; 280/11.22

[58] Field of Search ..... 188/5, 29, 6, 7, 188/19, 20; 280/11.2, 11.22, 11.19, 11.23

[56] References Cited

U.S. PATENT DOCUMENTS

| | | | |
|---|---|---|---|
| 1,608,238 | 11/1926 | Riefschnider | 280/826 |
| 1,949,163 | 2/1934 | Kasten | 188/5 |
| 1,985,726 | 12/1934 | Heldman | 280/826 |
| 2,129,260 | 9/1938 | Bowser | 188/5 |
| 2,516,852 | 8/1950 | Burry et al. | 135/72 X |
| 2,707,963 | 5/1955 | Goynes | 135/85 |
| 3,561,782 | 2/1971 | Tyrack | 280/816 |
| 4,023,817 | 5/1977 | Lah et al. | 280/816 |
| 4,288,102 | 9/1981 | Ramer | 280/823 |
| 4,386,794 | 6/1983 | Roberts | 280/826 |
| 4,744,584 | 5/1988 | Monreal | 280/809 X |
| 5,088,748 | 2/1992 | Koselka | 280/11.2 |
| 5,163,710 | 11/1992 | Chirtel et al. | 280/809 |
| 5,236,222 | 8/1993 | Fletcher | 280/809 |
| 5,251,934 | 10/1993 | Gates | 280/11.2 X |
| 5,253,882 | 10/1993 | Mitchell | 188/5 X |
| 5,301,704 | 4/1994 | Brown | 135/78 |
| 5,308,093 | 5/1994 | Walin | 280/11.2 |
| 5,312,135 | 5/1994 | Karabees | 280/826 |
| 5,335,924 | 8/1994 | Richards, Sr. et al. | 280/11.2 |
| 5,351,974 | 10/1994 | Cech | 280/11.2 |
| 5,374,070 | 12/1994 | Pellegrini | 280/11.2 |
| 5,388,673 | 2/1995 | Rohner | 188/84 |
| 5,487,552 | 1/1996 | Daoust | 280/11.2 |
| 5,564,718 | 10/1996 | Mitchell et al. | 188/5 X |
| 5,584,491 | 12/1996 | Kronyak, Jr. | 280/11.2 |
| 5,647,599 | 7/1997 | Visger et al. | 280/11.2 |
| 5,653,468 | 8/1997 | Ostapyk | 280/809 |

FOREIGN PATENT DOCUMENTS

| | | | |
|---|---|---|---|
| 600274-A1 | 6/1994 | European Pat. Off. | 280/11.2 |
| 17625 | 8/1896 | United Kingdom | 188/5 |

*Primary Examiner*—Robert J. Oberleitner
*Assistant Examiner*—Pamela J. Lipka

[57] ABSTRACT

A new hand-activated brake device and method particularly for in-line roller skates is shown having numerous forms and mounting locations. All forms use direct hand pressure to activate the brake. Optimum slowing, stopping and balance is achieved to include when used in hilly areas. For skaters of all levels: beginner to advanced. Left and right skates can be operated simultaneously or singly. A brake assembly is retrofitted or manufactured to the skate and a rod is pushed by hand. An optional padded elastic strap assembly is provided for holding a rod in an easy to reach position along the outer lower leg area and skate. A brake pad contacts the skating surface and automatically retracts to maintain a desired ground clearance when hand pressure is released. The user need not maintain a constant grip on anything. Has unique safety and convenience features and options.

8 Claims, 15 Drawing Sheets

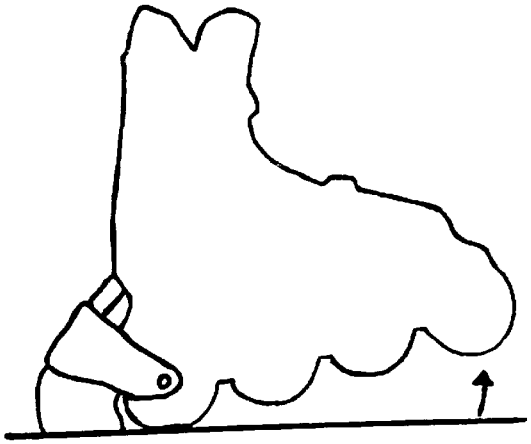
PRIOR ART FIG.1
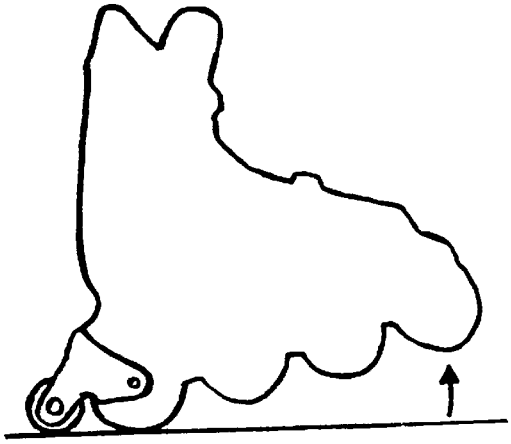
PRIOR ART FIG.2
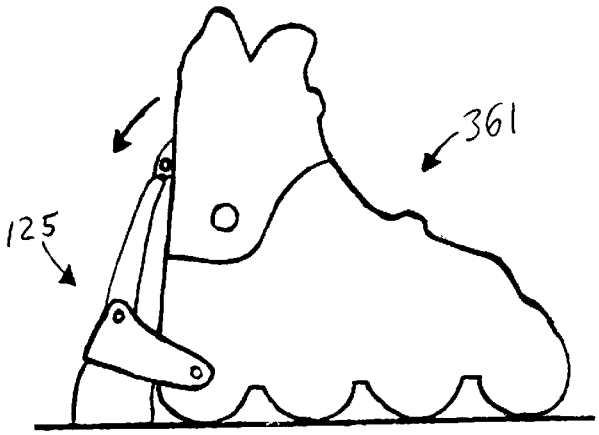
PRIOR ART FIG.3

FIG. 24
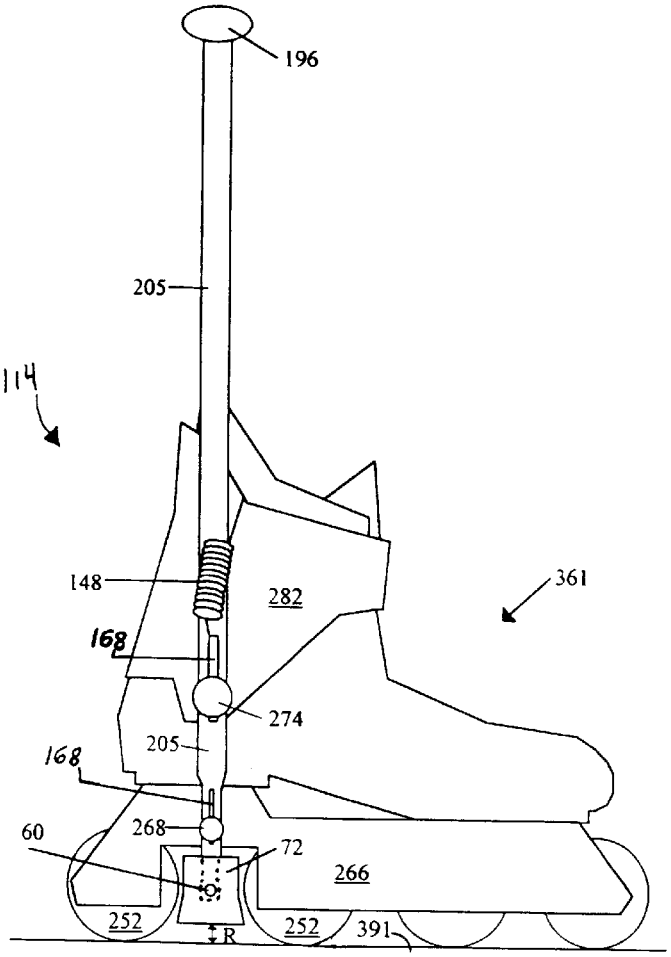
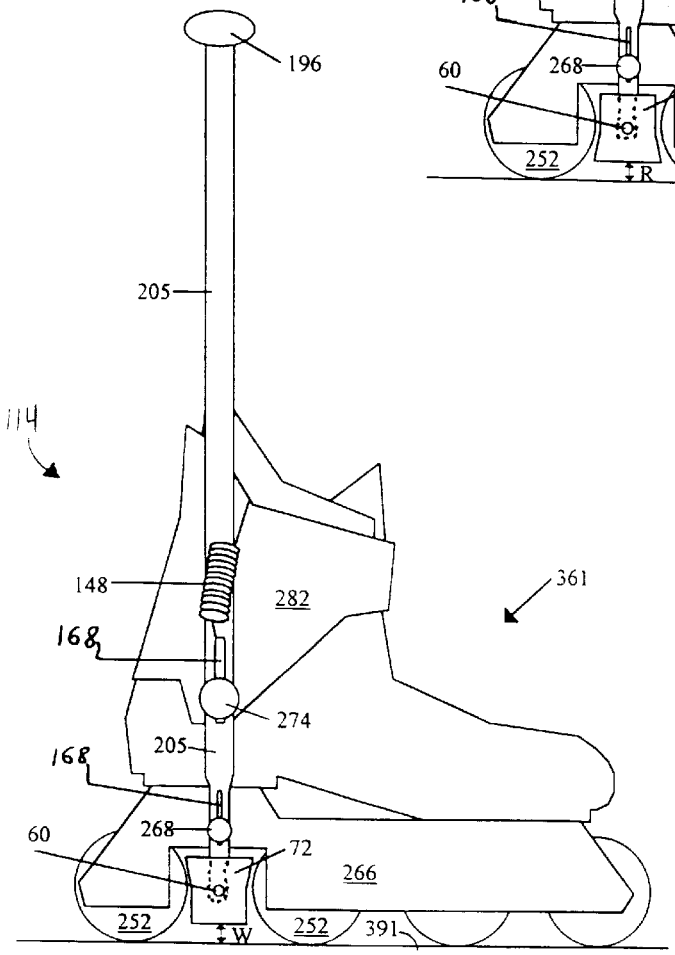
FIG. 25

HAND-ACTIVATED BRAKE AND METHOD

BACKGROUND

1. Field of Invention

This hand-activated brake assembly relates to foot-mounted wheeled vehicles. The most emphasis is placed on in-line roller skates due to their popularity.

2. Description of Prior Art

In-line skates allow users great freedom of personal movement. These skates provide a nonpolluting and quiet means for transportation, fitness and fun.

The number-one question in-line skaters have is: "How do I stop these things?" In-line skating is thrilling. But when you can't control your speed, the thrill can have detrimental consequences. The number-one cause of skate accidents is the inability to control speed. High speeds can be attained by beginners.

Consequentially, many beginning in-line skaters fall often and may lose interest in the sport, unable to attain braking proficiency. This has made many new skaters reluctant to use in-line skates, store them away or return them for a refund. This has also damaged the reputation of in-line skating. Much of the public and media considers the sport unsafe and insane.

These problems associated with ineffective skate brakes must be solved in order to allow in-line skating to become a reputably safe as well as an enjoyable sport.

Inventing an effective and practical device for slowing and stopping skates has always been challenging. There is only a small amount of space to place skate brakes, unlike other vehicles where limited space is not a major concern. In-line skate brakes cannot protrude anywhere on the inside of the skate because it would scrape upon the ground during leg strokes and could easily interfere with the other skate.

In-line skate brakes should use the direct power of the skater's hand. Direct hand pressure to activate the brake will allow the skater to use the total body to maintain the desired balance at all times when braking. The brakes should not use indirect hand pressure with cables to activate the brake. If the brake is mechanically activated, it should have an emergency brake which can be used in the event of a malfunction in the first brake used.

In-Line Skating Basics (1996) by Cam Millar describes that "If at any time you feel off-balance or out of control on your skates, bring your hands to your knees. By doing this, you make sure that your knees are slightly bent and that your upper body is in a slightly forward position. This will prevent you from falling backwards. A beginner's stance is hands on knees. Skaters should keep their hands on their knees while gliding. Keep your knees bent at all times when skating downhill. Bring your hands to your knees, stay low, and try to use your brake." It is obvious that the desired skate braking system should be located at the user's knees for activation because this is where skaters should put their hands immediately upon a need for braking or control. This will also allow for a lower center of gravity and prevent any fall backwards.

Skate brakes should offer body movement without the interference of cables, levers, belts and straps above the knees. Cable brakes take more time and skill to install. Bulky parts make cable brakes expensive to the consumer. Brake pad wear affects the performance of cable, cuff-activated and heel brakes. Cable and other hand held brakes generally do not allow skaters to wear standard protective wrist guards.

The brake should not require the user to hold any type of device in the hand while not engaging the brake. U.S. Pat. Nos. 5,312,135 (1994), 5,388,673 (1995) and 5,653,468 (1997) show rods that must be constantly held, severely restricting body movement and balance.

Many attempts have been made to market a skate brake that slows one or more skate wheels. This is the wrong approach. There is not enough wheel surface contact with the ground to brake effectively without quickly stripping the vulnerable wheels. When in-line skate wheels are dragged sideways for a skilled "T-stop" the wheels wear quickly and unevenly. As a result, these expensive wheels must be replaced more often and more time is needed to change them. These methods for braking the skate's wheels quickly make random flat spots on the wheels, creating a bumpy and dangerous ride. Braking the wheels gently to avoid flat spots on the wheels will not provide enough braking power to safely and ideally control speed.

The most widely used skate brake is the standard heel brake. It requires the skater to shift the weight of the non-braking foot, thrust the braking foot forward, and glide on the opposite foot all while re-shifting body weight to the braking foot to engage the ground with the brake pad of the braking foot. Sound confusing? It is, especially in practice. It is like a golf swing. You have to do a lot of things right—all at once. According to Popular Mechanics Magazine, "this method has serious drawbacks and does not deliver genuine stopping power." The required pivot arc forces the skater to jeopardize balance in order to apply the brake. If not precisely mastered, the skater will lose control and spin. But that's not all. As the brake pad wears, the required pivot arc increases. This further complicates balance.

The longer the wheel frame on any skate, the more problematic the standard heel braking technique becomes. A longer frame such as those found on speed and fitness skates is difficult to pivot on the rear wheel. It becomes more like trying to pivot a ski. Consequently most speed skaters do not or cannot use the standard heel brake. The desired brake does not require this pivot and can be used on fitness and speed skates.

When skaters pivot a toe up and a heel back, they do not use a strong muscle group. They use a weak leg muscle group. The desired brake should use stronger arm muscle groups where more energy is available when legs get tired from skating a length of time. Skaters can skate for a longer time due to less leg stress with such a brake.

Because the standard heel brake requires the skater to "ride" on the brake with all but one wheel off the ground, it is particularly dangerous on rough surfaces, bumps and gravel. The desired brake can be more safely activated on these surfaces.

The cuff-activated brake, currently dominated by one company, is activated by thrusting the equipped skate forward and putting pressure against the cuff (upper portion) of the one skate. This causes discomfort due to the pressure applied against the user's upper ankle. The brake is problematic because it's brake requires the user to hyper-extend a knee, especially as the brake pad wears. Hyper extending a knee can easily aggravate the knee if it is less than strong, This type of brake must have a brake pad placed dangerously close to the ground at all times and therefore can be unintentionally activated. As the brake pad wears, the skater must slide the braking foot farther forward. Therefore adjustments are often needed. The desired skate brake should not require inconvenient adjustments and should not demand unhealthy knee extensions.

Another disadvantage of both the cuff-activated and standard heel brakes is the problem of brake pad wear while descending long hills. As the brake pad wears the skater must constantly compensate for the pivot arc or the sliding of the braking foot. This is a major safety hazard when descending long hills because the user cannot adjust the brake pad if equipped with a cuff-activated brake while skating as the brake pad wears. The skater cannot replace the standard heel brake while skating as the brake pad wears. As a result the brake could fail when it is needed the most. The desired skate brake will never require any adjustments to compensate for brake pad wear for safety and convenience reasons.

U.S. Pat. No. 5,335,924 (1994) Richards, Sr. et. al. shows in its first embodiment a heel-activated braking system for in-line skates that is activated by tilting the equipped skate to release a normally compressed spring system that pushes a braking pad to the ground.

There are many problems with the first embodiment. In order to activate the brake, the skater must pivot the braking foot. Thus the brake has the same problems associated with other heel-activated brakes such as the awkward pivot arc, steps to be proficient at and raising wheels off the a ground.

In order to deactivate the brake the skater must come to a complete stop, squat down and reach behind the skate to grasp the hand knob, pivot the foot, lifting the front wheels off the ground to compress the spring and insert a flat rod into another rod slot. The brake is complex and difficult to manufacture and/or retrofit onto existing skates. Brake pad wear increases the required pivot arc for activation.

There are many problems with the second embodiment of the patent of Richards Sr., et al. There is a great risk that the skate will be lifted from the rear when the skater pulls on the cable. This would cause the skater to lose balance control as the rear wheels lift off the ground. Braking power is increased in conjunction with how hard the skater pulls up on the handle. The harder the cable is pulled, the more the rear wheels lift off the ground; therefore optimum braking power cannot be achieved.

U.S. Pat. No. 5,647,599 (1997) Visger et al. shows a hand-activated braking system that includes a semi-rigid shaft. The shaft is pulled upwardly for activation. This has the following serious problems: Like the Richards, Sr. et al. device described above, pulling upwards produces more stress upon the fingers than if the hand were pushing downwardly. A bulky hand knob is required. Braking power is limited because as the user pulls upwardly, the rear of the skate is also lifted because the axle is pulled upon. This is very dangerous. The system is designed for minimum ground clearance; therefore a larger, longer wearing brake pad cannot be used. The system does not have an automatic means for retraction and can therefore drag upon the skating surface. A means for retraction would cause the frontal area to be dangerously close to the skating surface.

Many patents show hand-activated cable-assisted skate brakes. U.S. Pat. No. 5,564,718 (1996) describes a system, like all other cable-assisted brakes, intended for the sole purpose of cable assistance where the user inconveniently routes a long cable and band grip up his or her body. It is not intended for use with a rod that would provide direct hand pressure to the movable brake pad. It is permanently confined to the skate and is difficult to retrofit onto other skates.

Structurally complicated solutions have been proposed. They require the use of many parts and are difficult to industrialize. None of the above inventions and patents, taken either in combination or singly, describes the structure, function and result of the instant hand-activated brake and method claimed.

OBJECTS AND ADVANTAGES

Accordingly, several objects and advantages of my hand-activated brake are:

(a) to provide a braking method which requires minimum skills to attain thereby eliminating the need to hire and pay for a certified instructor and is easily activated without the loss of balance, allowing the user to brake without the need to raise any wheels off the skating surface or hyper-extend a knee;

(b) to provide a skate brake which allows the user to maintain a desirable braking control and stability hands-to-knees stance;

(c) to provide a skate brake which can be activated by using hand and arm muscles where more energy is available after legs get tired, allowing user to skate longer periods of time due to less leg stress;

(d) to provide a skate brake which can be utilized on the left or right skate singly or simultaneously for added balance, power, decreased braking distance and an emergency brake;

(e) to provide a skate brake which allows skaters to slow and stop while descending hills that are difficult and dangerous to skate down safely with other brake systems;

(f) to provide a skate brake that does not interfere with body movement and offers compatibility with all protective gear;

(g) to provide a skate brake that does not require holding or gripping any object;

(h) to provide a skate brake that automatically retracts and provides a high amount of brake ground clearance to clear surface debris or objects and cannot be accidentally activated;

(i) to provide a skate brake where brake pad wear does not effect performance and does not necessitate any adjustments;

(j) to provide a skate brake that allows quick and easy removal and installation of skates;

(k) to provide a skate brake that easily and quickly retrofits and transfers to other skates;

(l) to provide a skate brake that is mountable in conjunction with other original brakes;

(m) to provide a skate brake which is mechanically simple, light-weight, inexpensive and requires minimum maintenance; and (n) to provide a skate brake which can be manufactured on skates or produced as a retrofitting accessory for most models.

Other objects and advantages are to provide a skate brake which can be easily grasped singly or dually for carrying, to provide a skate brake which can easily be adjusted to suit different user needs and leg lengths, and to provide a skate brake which allows the adaption of larger than usual brake pads for longer wear limits.

BRIEF DESCRIPTION OF DRAWINGS

FIG. 1 is a side view of a skate incorporating a prior art standard heel brake.

FIG. 2 is a side view of a'skate incorporating a prior art standard heel disc brake.

FIG. 3 is a side view of a skate incorporating a prior art standard cuff-activated brake.

FIG. 24 is a side view of a retracted strapless brake device manufactured on a skate.

FIG. 25 is a side view of FIG. 24 with a flipped upside-down brake pad.

REFERENCE NUMERALS IN DRAWINGS

Figure 4:
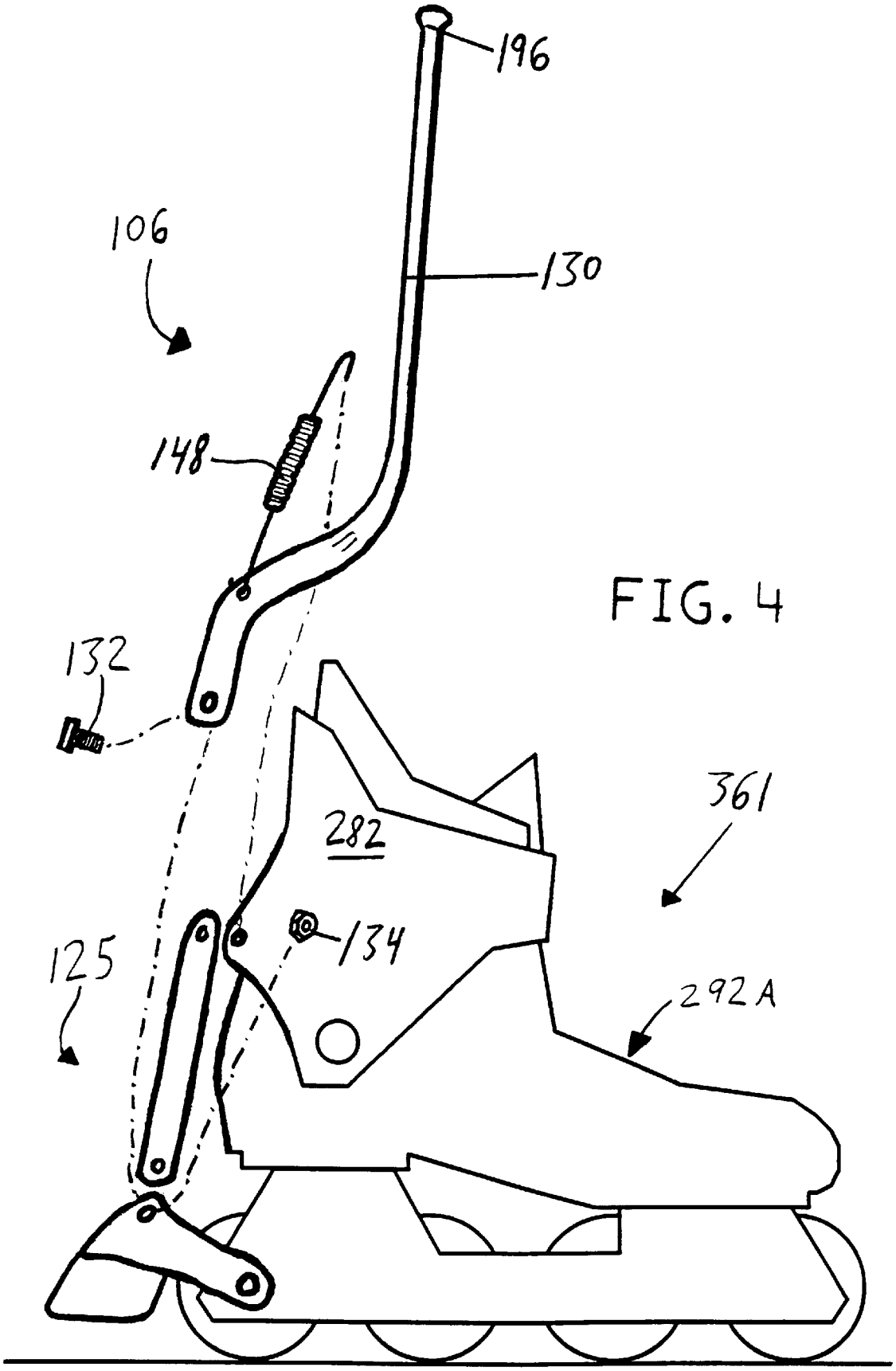
FIG. 4 is a side view of a retrofitting upgrade device with dashes illustrating a connection path to a skate incorporating a cuff-activated brake.

49 frame, wrap around type
50 brake frame, typical in-line
52 brake frame, speed skate
56 brake pad to brake frame connection
57 brake pad to rod connection
58 brake roller pad to rod connection
60 brake pad to rod connection
68 brake pad
69 brake roller pad
70 brake roller pad between wheels
72 brake pad between wheels, reversible
78 rod and brake frame pivot connection
80 rod and brake frame pivot, speed skate
86 recess or seat, speed skate
100 brake assembly, basic retrofit
102 brake assembly, roller glide type
102(A) brake assembly, roller glide type
106 cuff-activated brake transformation to hand-activated device
110 brake assembly, dual pivoting
110(A) brake assembly, roller pad type
112 brake assembly, shoe mounted, sliding type
114 brake assembly, between wheel type
116 brake assembly, single pivot on skate
116(A) brake assembly, single pivot on skate
118 brake assembly with front-mounted brake pad
122 brake pad wheel frame mount on skate
125 cuff-activated brake assembly
126 cuff-activated brake rod
127 cuff-activated brake pad frame
130 cuff-activated brake member transformation to hand-activated rod
132 cuff-activated brake mounting bolt
134 cuff-activated brake mounting nut
146 retracting compression spring
148 spring means, normally compressed
150 lower rod, with adj. means
152 rod slidingly attached to skate
156L left side lower rod for roller glide
156R right side or inner lower rod for roller glide
160 shaft or protrusion for gliding rod
162 shaft or protrusion for gliding rod
164 bearings or rollers for gliding rod
166 glide holder, skate to rod attach.
168 glide holder hole
172 spring recess, retainer or stopper
176 gliding roller between rods
176(A) gliding roller for single rod
188 rod adjustment knob or holding means
190 reflective tape
194 upper rod with single adjustment means
196 handle, grip, knob or grasping device
198 rod assembly, sliding
198A rod assembly, slidingly attached
200 rod
201 rod, pivotal speed skate type
202 rod, slidingly attached to skate shaft
205 rod for brake between wheels
208 rod, with wheel frame pivot
210 rod, pivots on wheel frame axle
214 rod for front roller pad mounted to cuff
216 rod for front roller pad, mounted to frame
241 axle of rear, four-wheeled skate
242 axle pivot connection of a wheel
244 hub or axle pivot
248 wheel hub bolt and nut
252 wheel, typical in-line skate
254 wheel, speed skate
262 frame member for wheels of skate
264 frame member for speed skate wheels
266 frame member for wheels, specially cut
268 rivet for sliding rod, skate wheel frame to rod attachment

270 rivet extension on cuff
272 rivet joint for cuff and shoe
274 rivet for sliding rod, skate to rod
282 cuff, typical in-line skate
292 shell of shoe or boot, typical in-line skate
292(A) shoe or boot, typical in-line skate
294 shoe, speed skate
300 elastic material
302 elastic strap device
306 cushion pad attachment points
310 cushion pad
314 hole in strap device between strap and pad for holding rod
320 hook and loop fasteners
351 speed skate
361 in-line skate, typical
364 four-wheeled skate, typical
378 knee pad or guard
381 leg of user
391 ground or skating surface

SUMMARY

A hand-activated skate method and assembly which can be retrofitted or manufactured on skates to provide optimum slowing and stopping power. A mechanically simple brake which is easily activated by way of direct hand pressure. Usable on left and right skates singly or simultaneously.

DESCRIPTION-MAIN EMBODIMENT

Figure 5:
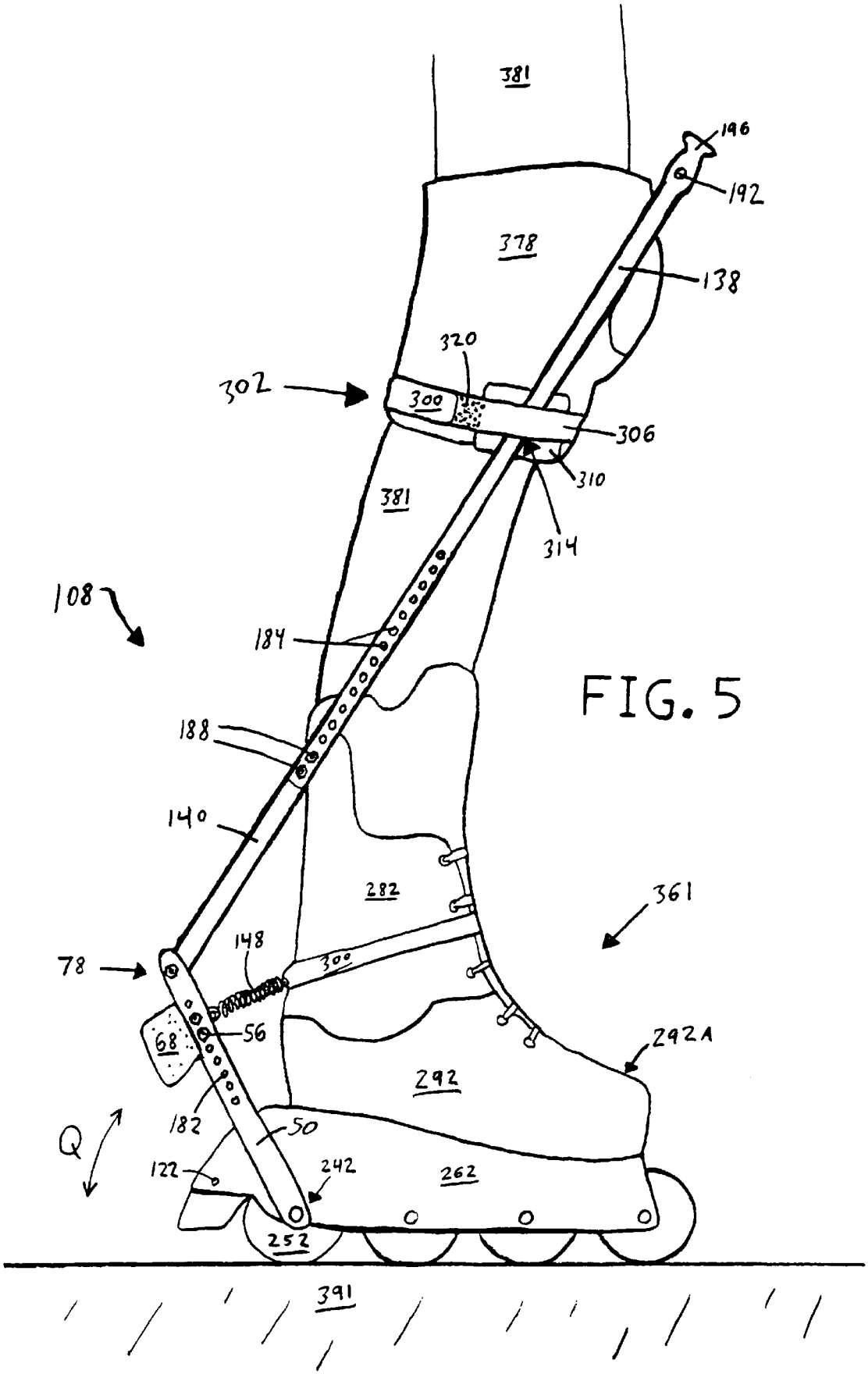
FIG. 5 is a side view of a brake device fitted on a skate and strapped on a user's knee guard or leg.
Figure 6:
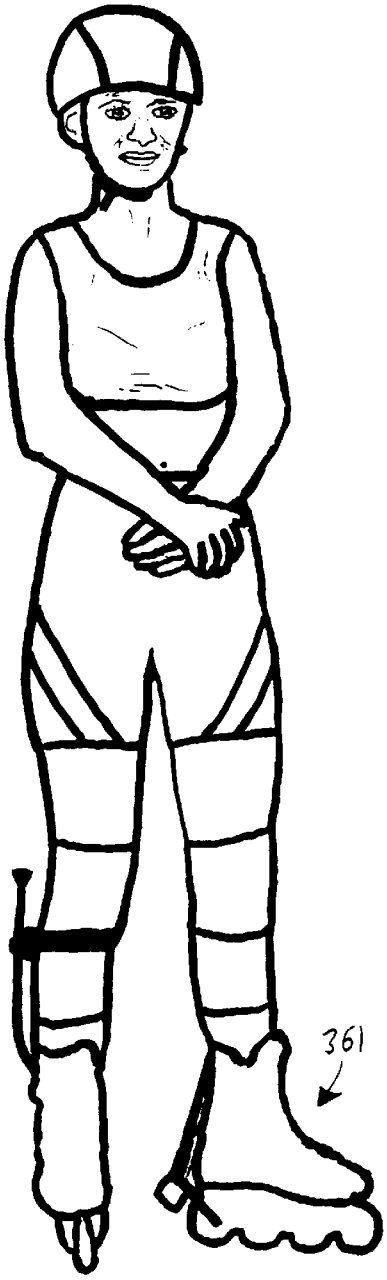
FIG. 6 is a front view of a user's right leg wearing brake device incorporated on a skate.

The preferred embodiment of the present hand-activated brake is illustrated in FIGS. 5 (side view), 7 (top view), 10 (perspective view) and 19 (side view). Going downhill backwards and applying the brake is dangerous and not recommended. This danger is reduced when frame is lengthened (see frame 50 in FIG. 5 for an example). It is preferred to have about 3–7cm. distance (or more if the skater anticipates skating in a hilly area) between the brake pad and the axle. An analogy may me made when comparing in-line skates to motorcycles. Some off-road dirt bikes are specially equipped with extra long wheel frames for use in very hilly areas. This makes the bike more stable and reduces the tendency for the bike to flip backwards or forwards.

In FIG. 5 a brake assembly 110 comprises of a brake pad frame 50 which is connected to skate 361 on skate's wheel frame 262 on a rear hub or axle 242. Pivot point 78 connects the brake pad frame and lower rod 150. Connecting bolt 188 connects rods 150 and 194 together. The brake assembly of FIG. 5 is retracted by way of a spring 148.

In the preferred embodiment, the brake frame is a lightweight alloy and is attached to a rear hub or axle 242 of the wheel frame; however the brake frame can consist of any other material that can remain rigid under stress, such as rigid plastics, composites, fiberglass, and metals. The preferred brake frame is a single piece to retrofit skates of any frame width. The brake frame is pivotally attached to wheel frame 262. To accomplish this, the axle or hub point 242 must be long enough to secure frame 50. A locknut should be used to allow a pivot with minimum friction and a secure hub bolt. When retrofitted, it is preferred to replace the stock or original rear hub bolt with one about one cm. longer with a fitting locknut. The locknut should be tightened all the way in and then loosened about two turns. The loosening about two turns provides pivoting of the brake assembly.

Brake pad 68 can any shape, size, form or composition so long as it fits securely to the brake frame 50 and can frictionally interact against a skating surface. A preferred brake pad should be made out of a durable rubber intended for ground engagement. Due to the high ground clearance available, the brake pad is preferred to be as large as possible to last long and offer more surface braking. The brake pad attachment 56 is a locknut and a bolt, but can be any other device for attaching brake pad securely such as a screw. Preferably the brake pad is shaped to fit into the brake frame in a manner that the brake pad is seated in the brake frame at the top of the brake pad.

Pivot assembly 78 comprises a locknut and bolt. Pivot assembly 78 is the connecting point of brake frame 50 and the rod The pivot assembly should be constructed as to minimize friction by utilizing friction reducing washers.

Figure 10:
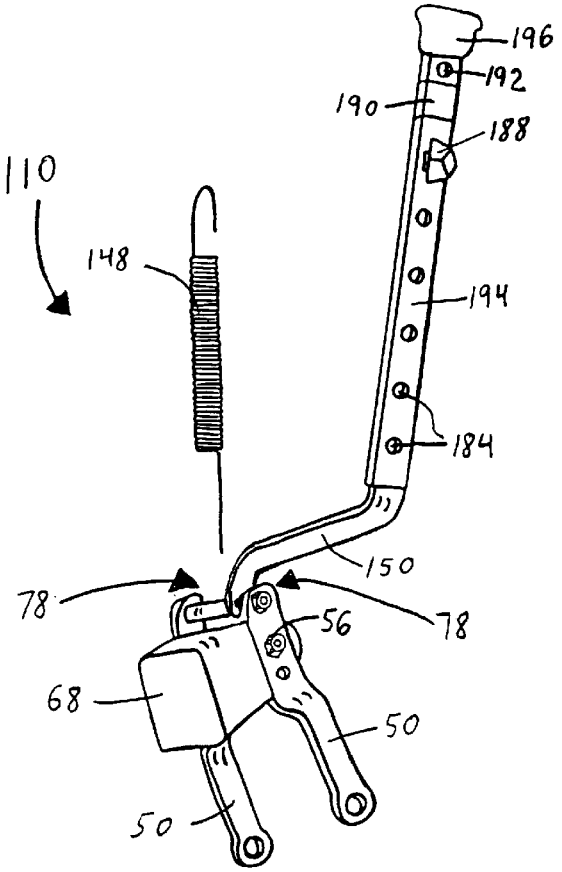
FIG. 10 is a detailed perspective view of a retrofit type brake device.

A length adjustable upper rod 194 is connected to rod 150 with an adjustment knob or screw 188. Rod 194 is shown in detail in FIG. 10 Rod 194 slidingly fits into or onto rod 150. Rod 194 is held place with knob 188. Knob 188 should be assembled with a lock washer (not shown) for preventing the knob from coming loose. Rod 194 is contoured to adjustably fit any lower rod.

A handle or knob 196 is the top-most part of the hand-activated brake. This handle can be any size, shape, form or material as long as it fits well in a hand and is firmly attached to a rod with either glue or any other fastening device. The handle can be a fixed part of the rod and does not necessarily have to be a separate part. The handle should be made out of a soft rubber material for maximum comfort when pushing. An optional piece of reflective tape 190 is mounted or affixed to the highest spot possible of the upper rod. A normally compressed spring 148 is attached to the lower rod 150 or frame 50. Spring 148 can be any type of spring as long as it retracts to its original shape when used under stressful conditions. Its hooks should be made of a metal and should be strong enough to pull the entire brake assembly upwards repeatedly. The top end of the spring is placed or mounted on the skate. The spring can be hooked over the top of a skate so long as the spring is stable when used.

Figure 7:
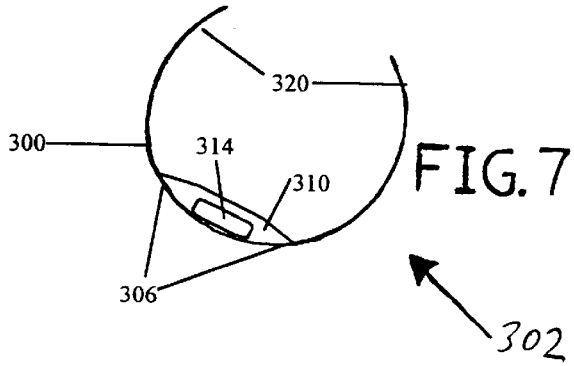
FIG. 7 is a top or bottom view of a padded strap device that holds a rod to a user's leg.
Figure 8:
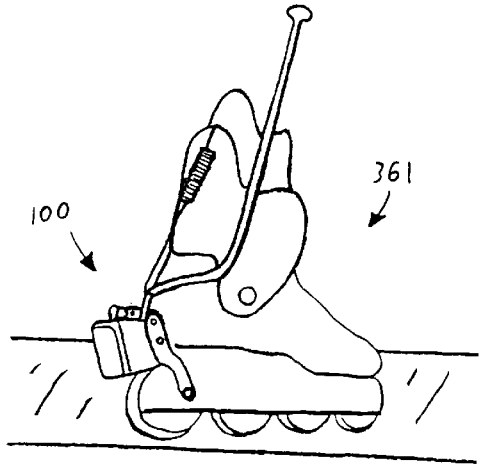
FIG. 8 is a perspective view of a retracted brake device retrofitted on a skate.
Figure 9:
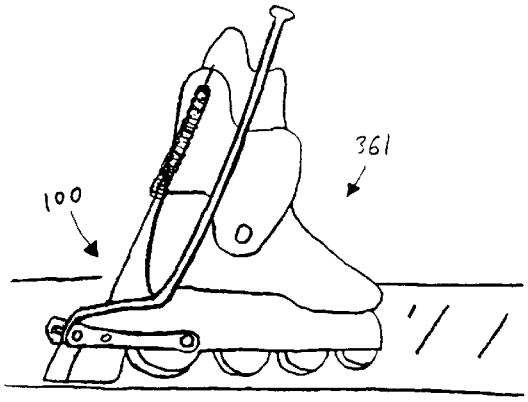
FIG. 9 is a perspective view of FIG. 8 in the activated and extended position.

A strap assembly 302 of FIGS. 5 and 7 comprises of an elastic strap 300, a cushion pad 310, a hole 314, and a hook and loop fastener assembly or Velcro assembly 320. The hook and loop assembly should be sewn to the elastic strap at about 50 percent of the strap length to allow different fitting options. The elastic strap should be long enough to be fitted around any size of a user's leg. It should be about 3 cm. wide and 30 cm. long. Cushion pad 310 should be any kind of strong and comfortable pad about 6 cm. by 6 cm. and should be permanently sewn or glued onto the strap at two of the pad's side attachment points 306 so as to allow hole 314 to exist. This hole needs to be large enough to allow above rods to slide up and down in it and small enough to contain the rods from moving outwards or sideways. The strap device is worn by the user around a leg 381 and preferably around and with a knee pad or guard 378. The strap can be built onto the knee guard. Or the knee guard's lowest strap can be used to replace strap 302.

It will be appreciated that there can be other variations of the hand-activated braking assembly shown here without departing from the spirit of the hand-activated brake. The described embodiment is the most preferred embodiment of the inventor; however it should be clear that improvements are possible as more research, development, testing, and observation time all increase.

OPERATION-MAIN EMBODIMENT

The method and use of the present brake assembly of this hand-activated brake will now be explained. The method and use of the invention is simple. The method includes using a brake assembly 110 to slow or stop the skate, with the assembly being hand-activated by a rod 194 or extension so as to bring a brake pad 68 that is operatively connected to the carriage or frame member 50 into contact with the skating surface 391. This method permits the user to activate the brake without changing the angle of the skate itself relative to the ground-that is, the user need not lift or lower the heel or toe of the skate. Further, the user need not slide a foot forward in order to move a cuff back.

The method of this hand-activated brake further includes the option of using two brakes, one on each skate and includes using a strap assembly 302 to secure the upper rod 194 needed to activate the brake. An emergency braking method involves using the other non-failing brake assembly or lifting the toe of the skate so that the skate can then be stopped like a traditional heel-activated skate brake, depending on the ground clearance of the brake pad. All of the various components necessary to carry out this method have already been explained.

The steeper the braking area, the more both brakes should be used. In addition, two brakes should be used when stopping as quickly as possible as needed in congested areas and at higher speeds.

The rods can be adjusted by unscrewing the adjustment knob 188. Then the upper rod slides up or down until a desired height is accomplished. The adjustment knob is then screwed in securely. Hand tightening is sufficient if the knob is large enough to provide hand leverage and one or two lock-washers are used.

For safety reasons, the user should operate the brake while slightly leaned forward. This provides a better center of gravity and lessens the chance of a rearward fall.

The user should not attempt to accomplish higher speed braking until the user gets used to the new method. A special helmet designed for skating should be worn as it provides more back of the head protection than a bicycle helmet. Wearing wrist guards does not affect brake activation and is recommended for added safety. In addition wrist guards absorb pressure from applying the brake resulting in added comfort.

Safety reflective tape 190 should be located at the top of the rod and in a place where the strap assembly will not block its view. The higher location is more visible because of the line of sight is usually at a motorist or pedestrian eye level.

The brake assembly also includes a method for retrofitting the brake to an existing skate. This retrofitted method includes removing the axle or brake bolt from a wheel or part of an existing skate; placing the pivot point of the brake frame member over the axle; and then replacing the axle or brake bolt so as to secure the structure in place. A longer than original bolt may be needed due to the possible extra width of the brake frame. If an original brake frame was removed from the hub area, then a longer hub bolt may not be necessary. This is especially the case if the retrofitting brake frame is the same size or smaller than the removed original brake frame.

Furthermore, both activation and deactivation of the braking device is very simple, so as to allow to obtain a device which is structurally simple and easy to industrialize and can also be easily applied to known skates. When applied to known skates, some small hardware changes may be necessary such as providing a longer hub or axle bolt (not shown in detail).

It should be apparent to one skilled in the art that numerous changes and adaptations can be made that will make the brake operate differently. Naturally, the materials and the dimensions which constitute the individual component operation of the device of the present invention may be the most pertinent according the specific requirements.

DESCRIPTION AND OPERATION OF ALTERNATIVE EMBODIMENTS

Braking assemblies generally for foot-mounted wheeled vehicles are provided for roller skates 351, 361 and 364. As such, skates 351, 361 and 364 can all utilize any of the braking devices throughout the drawing figures. A certain braking device shown in any figure does not limit its use on the particular skate shown. All figures show braking devices that can be mounted on most foot-mounted roller skates with a plurality of wheels or rollers.

In addition, the hand-activated brake and method can be applied to skate boards and snow skis (not shown). If the present invention is applied to a skate board, the operation would be the same but the strap means would be deleted. The brake pad frame member would be mounted to the skate board rather than the rear hub or axle as shown on skates. The best illustration is FIGS. 22 and 23 where protrusion 160 would protrude from the skate board at the back end and hold the rod in place.

When the present invention is utilized for snow skiing or off-pavement skating (not shown), the brake pad would be replaced with a scoop-like protrusion for slowing and stopping in snow or natural ground. The brake frame would be mounted to the ski boot or the ski itself. This would be particularly useful for beginners who have a need to slow and stop skis safely while learning how to ski.

A cuff-activated brake assembly 125 mounted onto an in-line skate 361 is shown in FIGS. 3 and 4. A cuff-activated brake conversion rod and spring 106 shown in FIG. 4 attaches to cuff-activated brake assembly 125 with maximum simplicity. The cuff-activated brake is converted or transformed into a hand-activated brake by detaching cuff-activated brake rod 126 from the skate. Then a bolt 132 and a nut 134 or any other bolt, cotter pin, etc. connects a rod device to the cuff-activated brake assembly's rod 126 or the brake pad frame 127. A spring 148 is attached anywhere on the rod 130 or brake frame 127 and onto a skate 361. This simple conversion allows cuff-activated brakes to be converted into hand-activated brakes thereby allowing the brake assembly 125 to be used in a manner different than it was intended to be used. The operation is as follows: The user pushes down on handle 196 and activates brake assembly 125. The brake pad of brake assembly 125 is frictionally engaged against the skating surface to slow or stop the skates. The brake pad automatically retracts when the user is finished braking.

The symbol "Q" represents the distance between the brake pad 68 and the ground 391. This distance is shown to be greater than the distance of the brake pad to ground distance of the original brake mounted at point 122.

Figure 11:
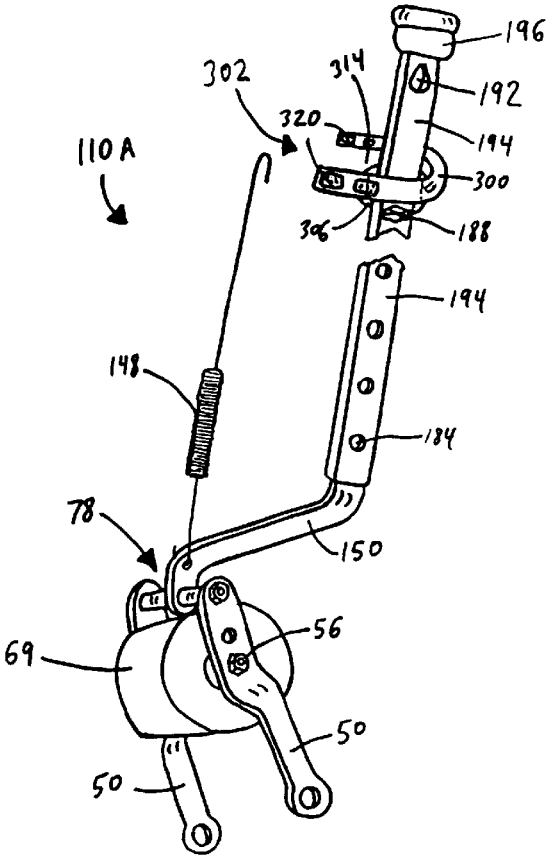
FIG. 11 is a detailed perspective view of a retrofit type brake device.

FIG. 11 shows a retrofitting brake assembly 110A. The brake pad frame 50 mounts to the wheel frame and pivots at that point. The brake pad frame is pivotally mounted to a lower rod 150. Roller brake pad 69 is an anti-skid and anti-lock brake pad intended to be used by users who prefer a more quiet a more non-marking brake pad. It is made out of rubber and, when engaged, rotates similarly to recreation skate wheels 252 but with friction at fastening point 56. Point 56 is a tight fit, but not so tight as to prevent the roller brake pad from turning.

Figure 12:
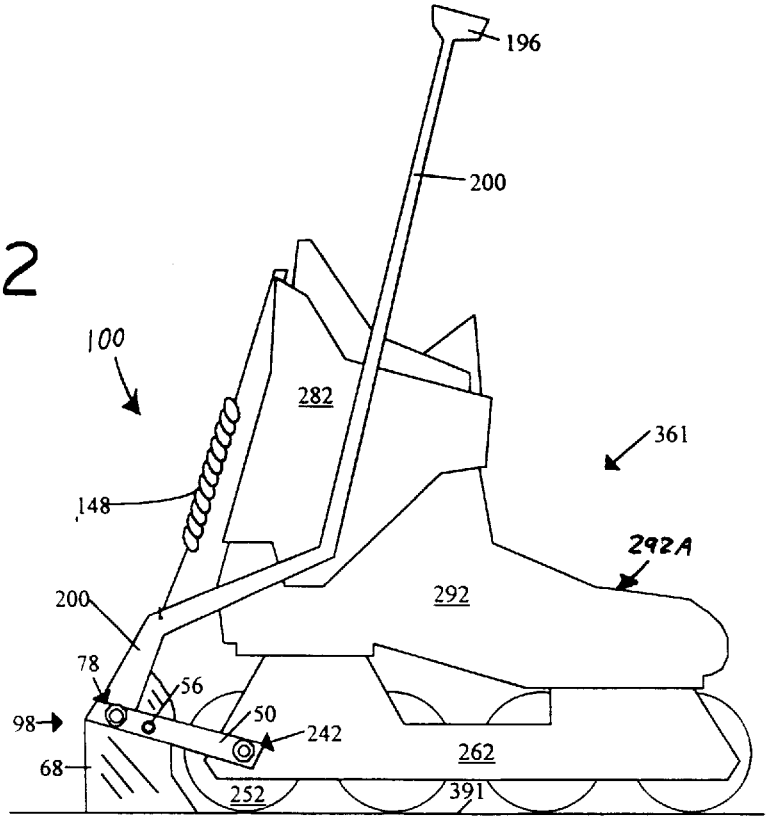
FIG. 12 is a side view of an extended brake device retrofitted on a skate.
Figure 13:
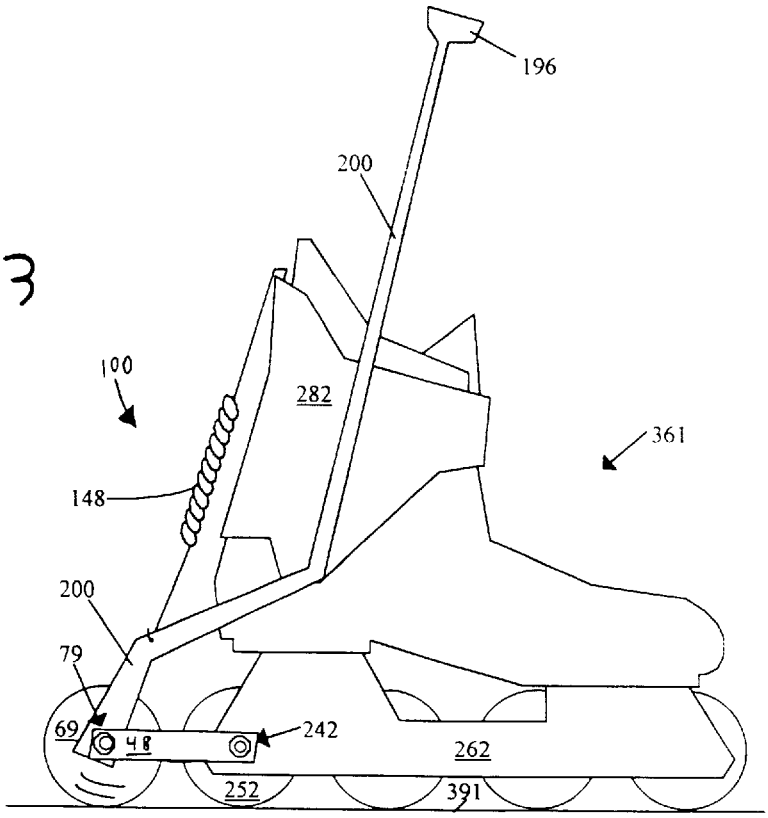
FIG. 13 is a side view of an extended brake device retrofitted on a skate.
Figure 14:
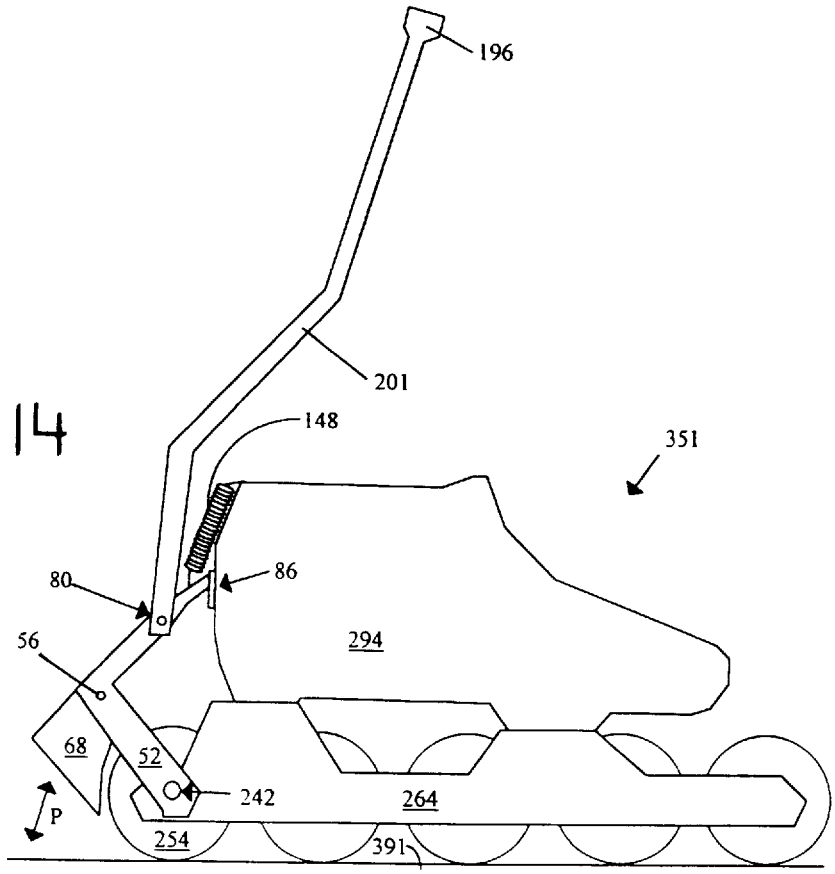
FIG. 14 is a side view of a retracted brake device retrofitted on a speed skate.

FIGS. 12 and 13 show a brake assembly 100. A rod 200 is non-adjustable and is a single piece. A frame 50 for the roller pad is different from non-roller pad frames because it cannot wrap immediately around rod 200. It can optionally wrap around the rod if the frame is extended an additional 2 cm. to the rear. A rod and brake roller pad pivot 78 is structured such that the the top that rests against a shoe 294 when retracted. A spring 148 is attached to brake pad frame 52 and the back of the shoe. The recess prevents the brake pad frame from retracting too far forward. The reference letter "P" designates the distance between the brake pad and the ground. A speed skate wheel 254 is usually larger than a typical skate wheel and is attached to a frame member 264.

Figure 15:
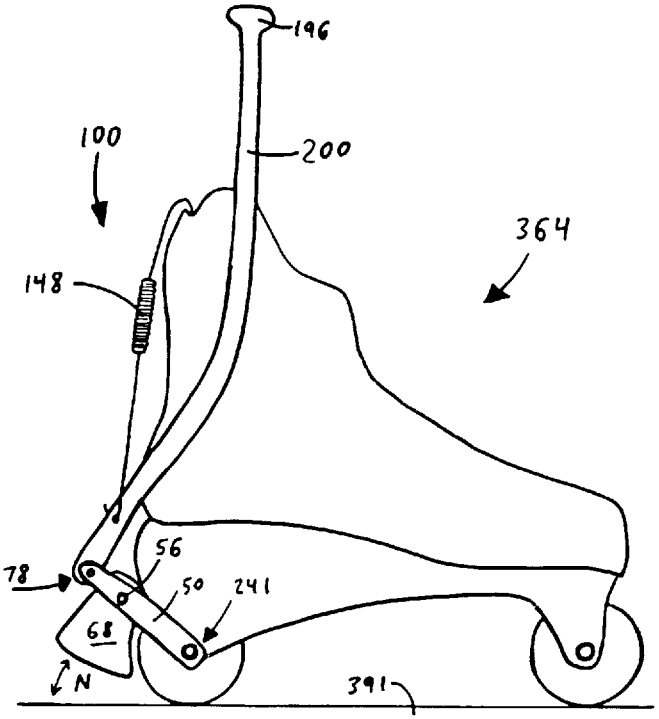
FIG. 15 is a side view of a brake device retrofitted on a two or four-wheeled skate.
Figure 16:
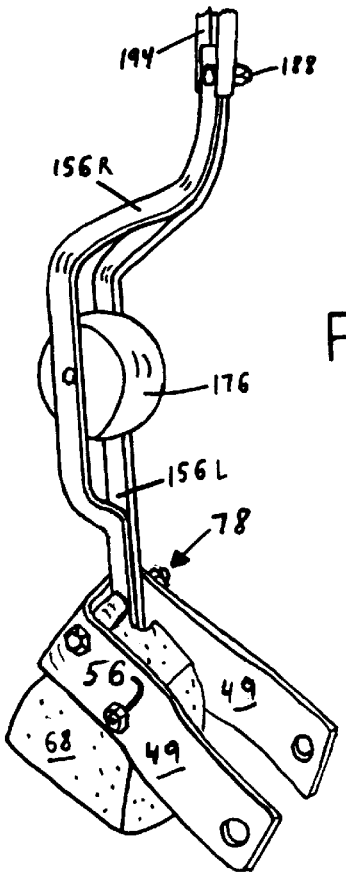
FIG. 16 is a detailed perspective view of a retrofit strapless type brake device.

FIG. 15 shows a typical roller skate 364 with either two to four wheels or two to four rollers and shows how the brake assembly 100 can be applied to such skates. The brake pad frame is pivotally mounted to a rear axle point 241 or the wheel frame (no reference numeral shown). The reference "N" designates the distance between the brake pad and the ground.

Figure 17:
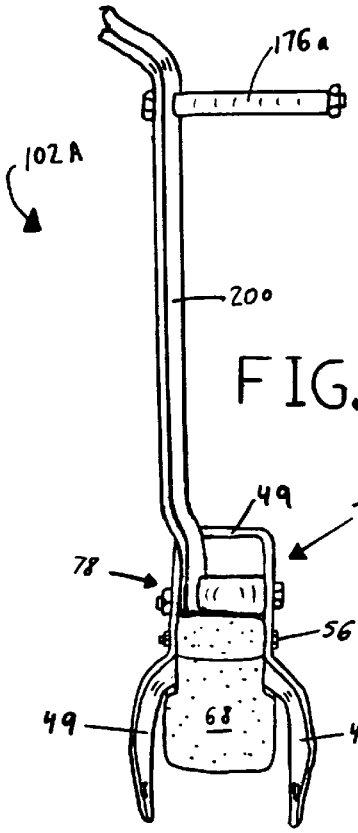
FIG. 17 is a detailed top view of a retrofit strapless type brake device.

FIG. 17 shows a brake assembly 102A similar to brake assembly 102, but with more simplicity. Pivot point 78 contains two spacers, a nut, a bolt, and attaches the brake pad frame to a rod 200. Roller 176A performs the same function as roller 176. Roller 176A is any type of roller with a hollow center to allow a long bolt the pass through its center and a locknut is at its end. The locknut should be tight enough to secure the roller and loose enough to allow the roller free movement for gliding up and down the back of the skate.

Figure 18:
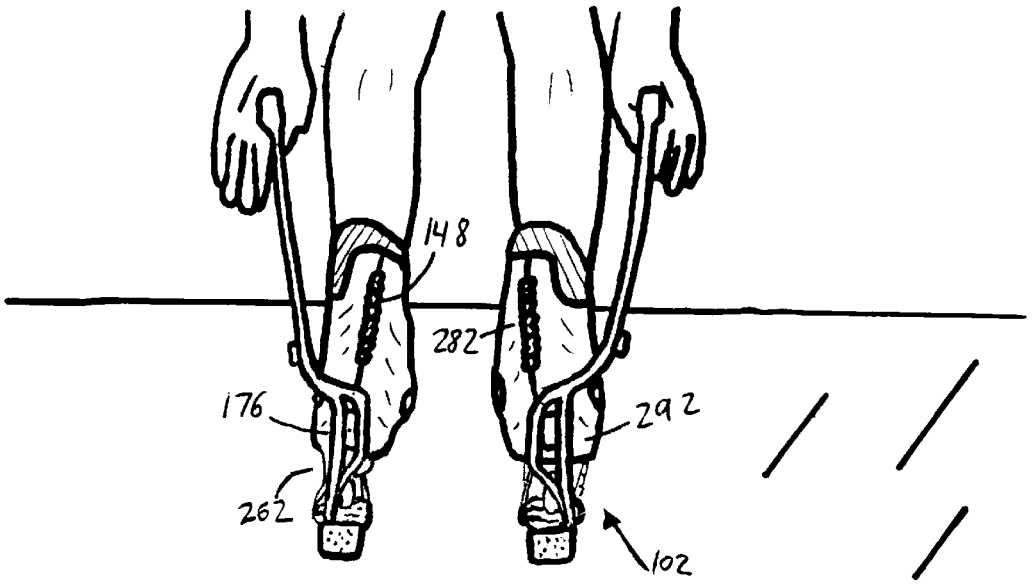
FIG. 18 is a rear view of retrofitted strapless brake devices being user-activated.
Figure 19:
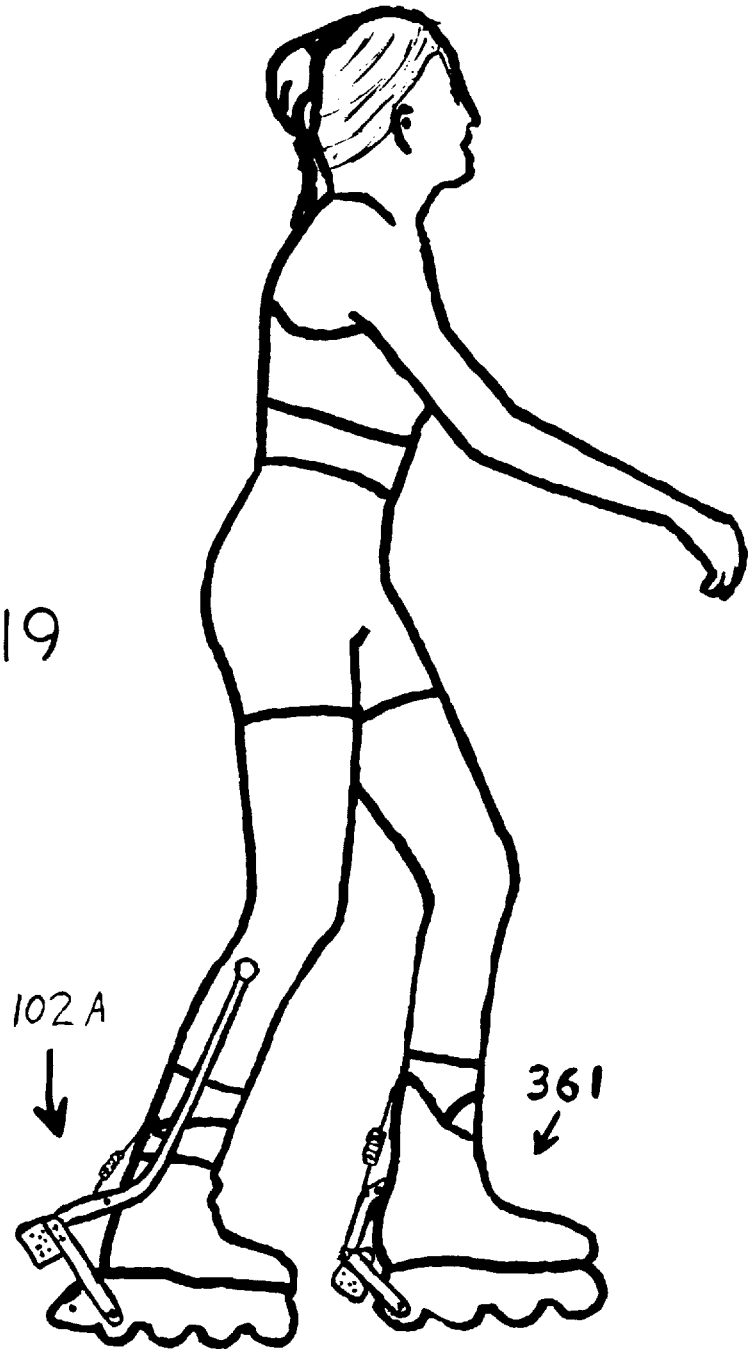
FIG. 19 is a side view of a person wearing retrofitted brake devices.

FIG. 18 shows how the device of FIG. 17 mounts upon a pair of skates and legs. The brakes are shown in the activation stage.

Figure 20:
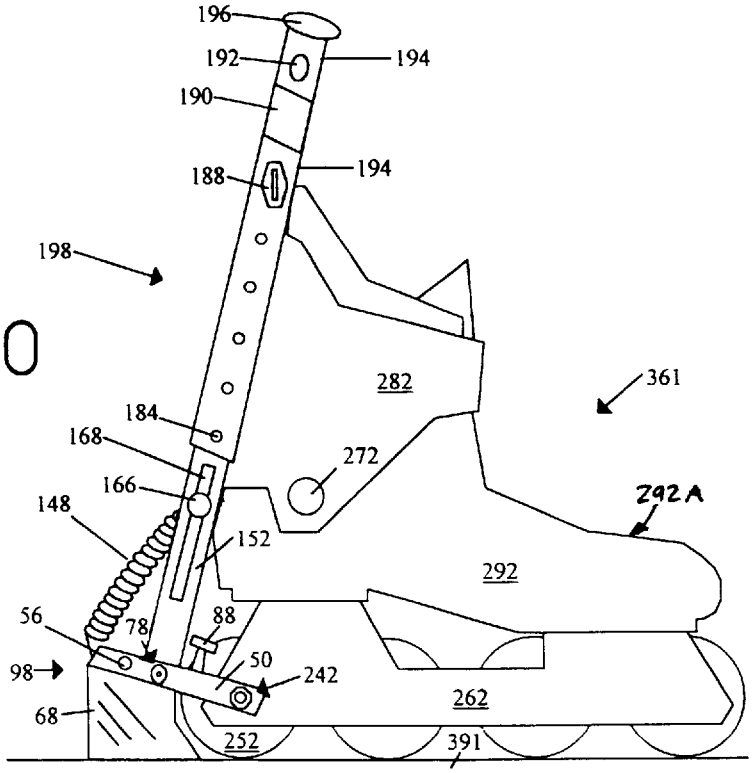
FIG. 20 is a side view of an extended strapless brake device manufactured on a skate.

FIG. 20 shows a brake assembly 198 which is intended to be manufactured onto skates. It additionally consists of a mounting point 166 that connects the skate shoe 292 to a sliding rod 152 through a hole 168. Point 166 is permanently affixed to the skate because it is an extruding rod with a flat dime-like end to hold the rod 152 in place. Rod 152 slidingly goes up and down the point 166.

Figure 21:
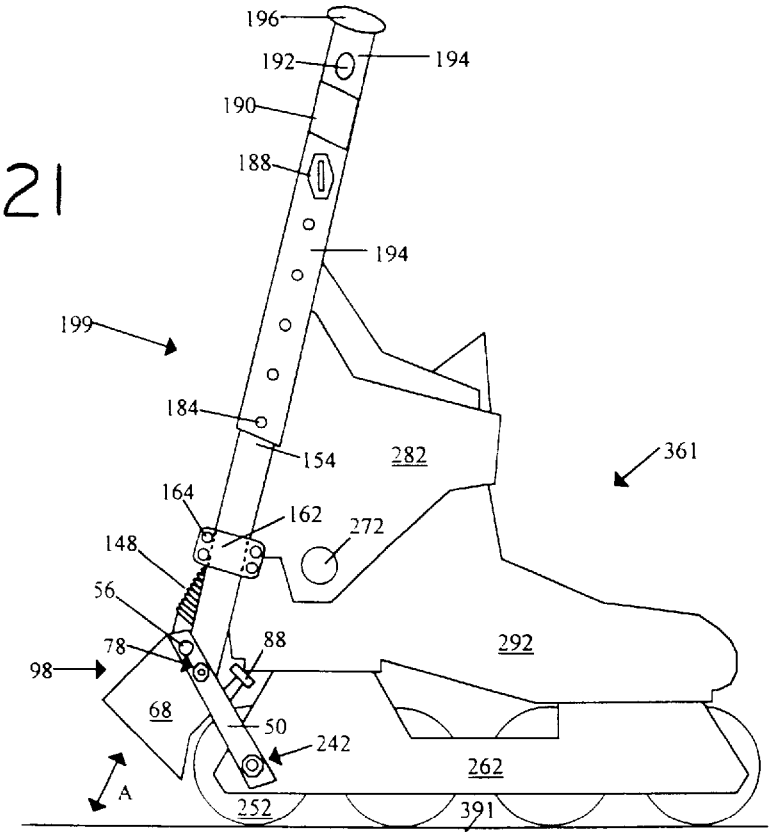
FIG. 21 is a side view of a retracted strapless brake device manufactured on a skate.

FIG. 21 shows a brake assembly 198A which is intended to be manufactured onto skates. It consists of mounting point, shaft, or protrusion 162 which is permanently attached to the skate shoe 292. Mounting shaft 162 consists of an assembly of either bearings or rollers 164 that serve as a friction-reducing method for allowing the rod 200 to slide up and down inside mounting shaft 162. Shaft 162 is simple in design and no details are shown.

Figure 22:
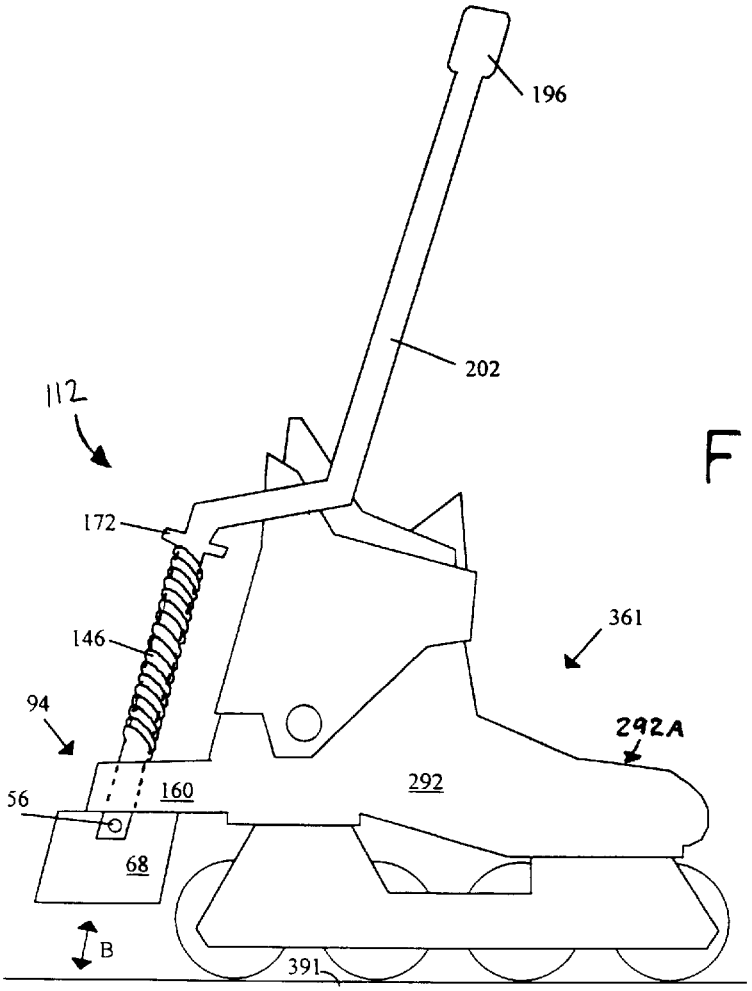
FIG. 22 is a side view of a retracted strapless brake device manufactured on a skate.
Figure 23:
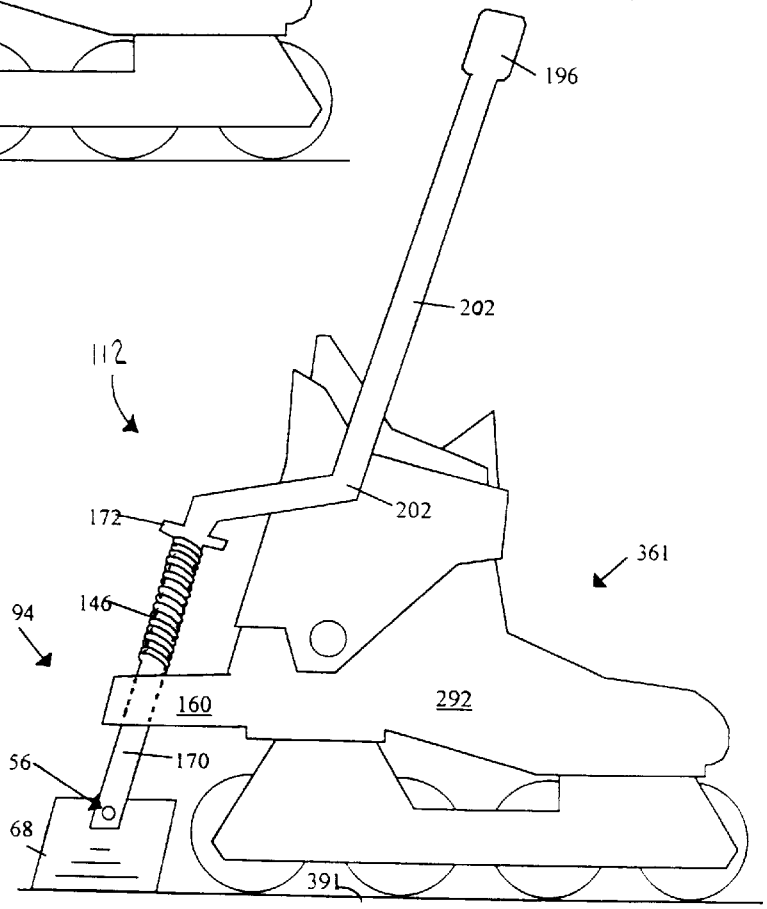
FIG. 23 is a side view of FIG. 22 in the extended position.

FIGS. 22 and 23 show a brake assembly 112 that is manufactured onto skates. A shaft, protrusion, or mounting location 160 is provided as a link between the skate and a rod 202. It serves a similar function of shaft 162 in FIG. 21. The rod slidingly operates inside the shaft. The shaft holds the rod in place. A compression spring 146 is compressed during brake activation as shown in FIG. 23 and the spring is decompressed when the brake is not used as shown in FIG. 22. The spring is operatively mounted to the rod such that the rod goes through the center of the spring. A spring retainer 172 holds the spring in place at the top and the shaft 160 holds the spring in place at the bottom. A brake pad assembly 94 has a letter "B" designated as the distance between the brake pad and the ground.

Figure 26:
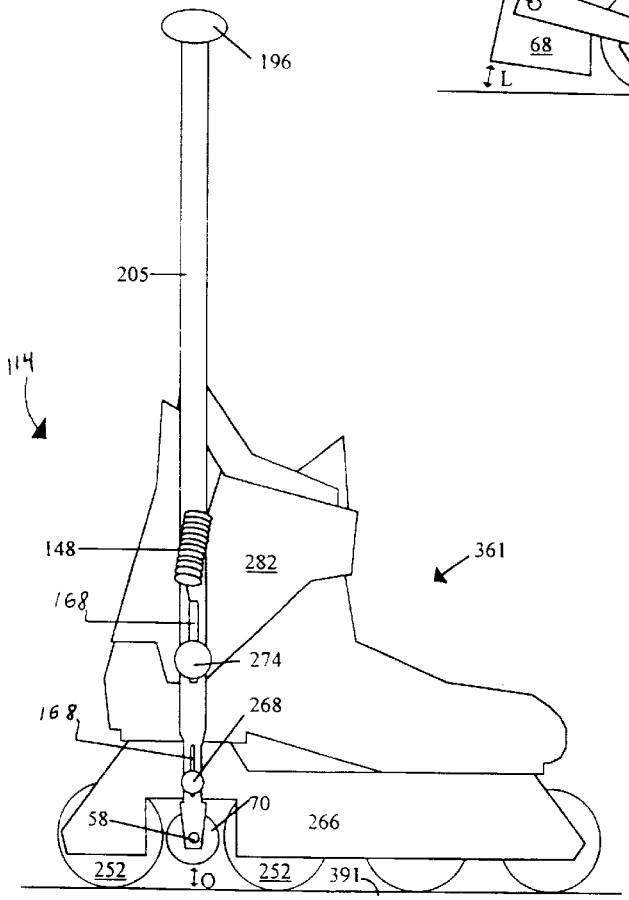
FIG. 26 is side view of FIGS. 24 and 25 with a roller instead of a fixed pad.

FIGS. 24 through 26 show a brake assembly 114 that is manufactured onto skates at mounting points 274 and 268. Mounting location 274 serves to hold a rod 205 in place and to allow cuff 282 to pivot. A hole set 168 allows the rod to be raised and lowered. The rod is curved outwards between the lower hole and the mounting location 274. A spring 148 is mounted from the rod hole to the cuff or any other sufficient or predetermined place and serves to retract the rod after the rod is released by hand. The reference letters "R", "W", and "O" represent the distance between the ground 391 and brake pads 70 and 72. The brake pads are mounted to the rod at points 58 and 60 in the center of the pads and between the wheels. These special brake pads do not protrude from the sides of the skate and are approximately the width of specially cut wheel frame 266.

The brake pad 72 can be operated in two ways, depending on the way it is mounted to the rod. In FIG. 24, the brake is ground engaging due to the brake pad's orientation. If the pad in FIG. 24 is mounted upside-down, it will be wheel-engaging as shown in FIG. 25. The shape of the brake pad is unique in that it is attached to the rod in its center where the rod is bent twice to fit under the skate frame cut-out area. Point 60 is a nut and bolt mount that secures the brake pad to the rod.

FIG. 26 shows brake assembly 114 with a roller brake pad 70 mounted to rod 205 at mounting point 58 and a roller brake pad to ground distance "O". The roller brake pad performs the same function as brake roller pad 69 as shown in FIG. 13. The roller brake pad is small enough to fit between the two wheels.

Figure 27:
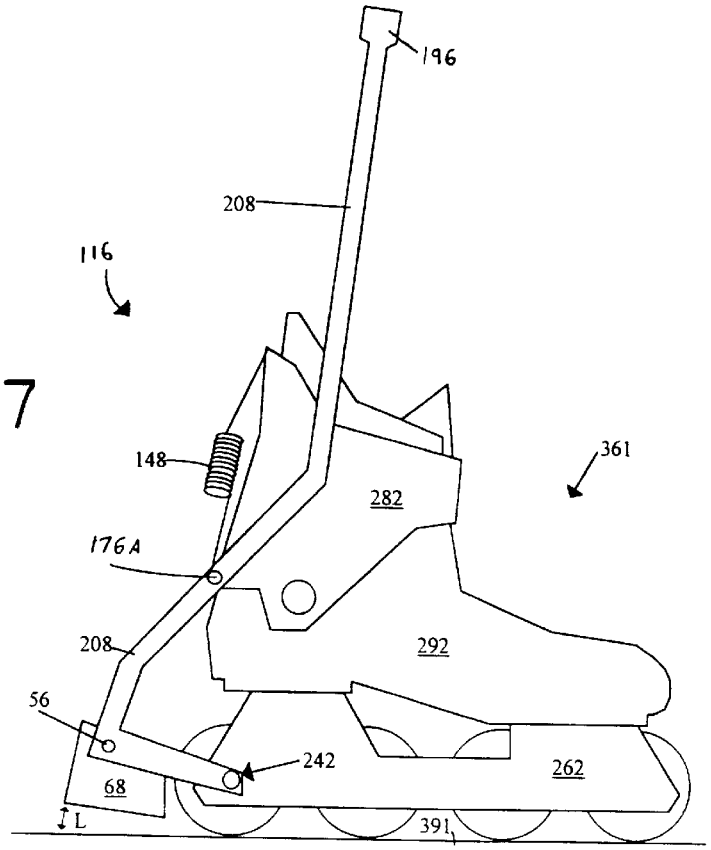
FIG. 27 is a side view of a retracted strapless brake device retrofitted on a skate.

FIG. 27 shows a brake assembly 116 that is operated not by pushing a rod 208 downwards, but rather backwards to engage the brake pad against the ground. Here the spring is mounted to the roller device 176A. The roller device is shown rested up against cuff 282. This keeps the rod from falling forward.

This alternative method for slowing and stopping skates is easy to utilize: The user pushes rod 208 backwards to eliminate the distance "L" and thus engage the pad against the ground. The user should not push back too hard or else the rear of the skate will lift up. This applies to FIGS. 27–29. This applies to FIGS. 30 and 31 where if the user applies too much pressure by pushing a rod 214 or a rod 216 too hard the front of the skate will lift up.

Figure 28:
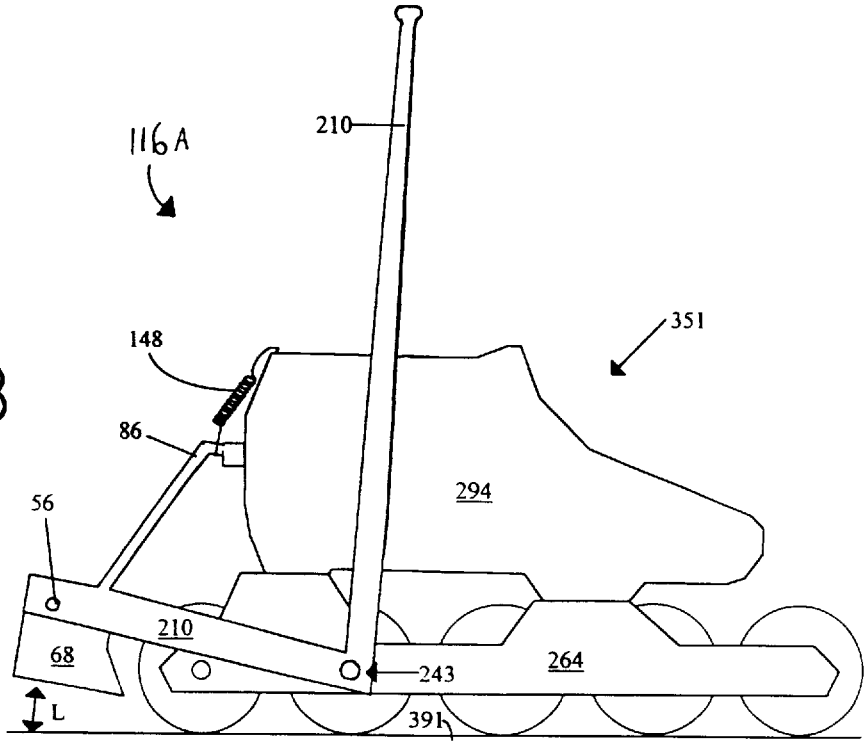
FIGS. 28 and 29 are side views of retracted strapless brake devices retrofitted on a skate.
Figure 29:
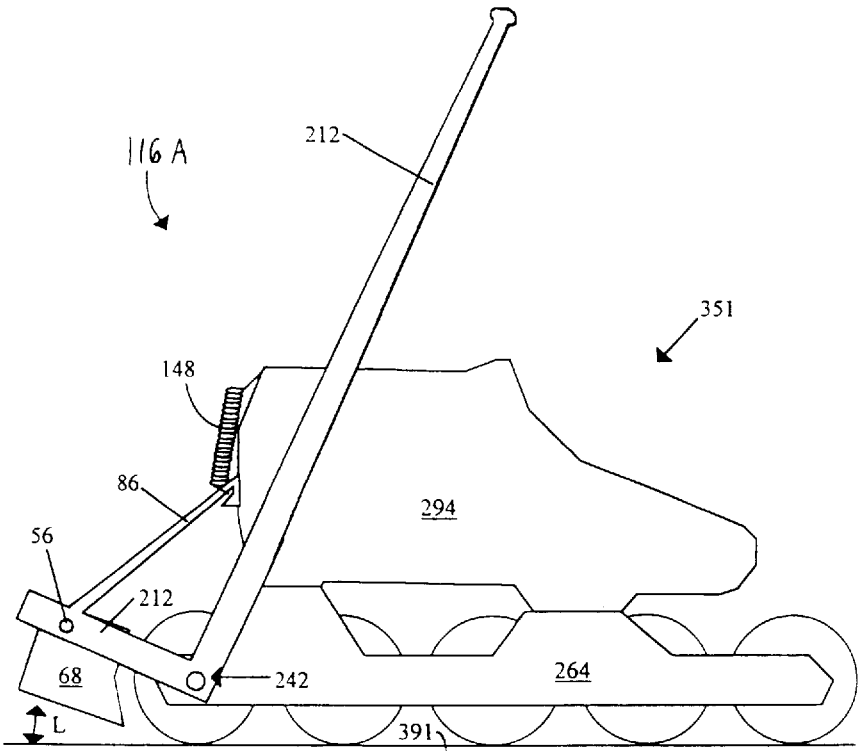

FIG. 28 shows a speed skate with a braking assembly 116A retrofitted at axle mounting point 242. A rod 210 is a single piece non-adjustable simple operatively mounted device for pushing the brake pad against the ground by hand. Brake pad ground clearance is assigned by the letter "L". A recess seat 86 is permanently attached to the rod to hold the spring and to rest the brake assembly against the brake shoe. FIG. 29 shows a rod 210 pivotally connected to the axle point.

Figure 30:
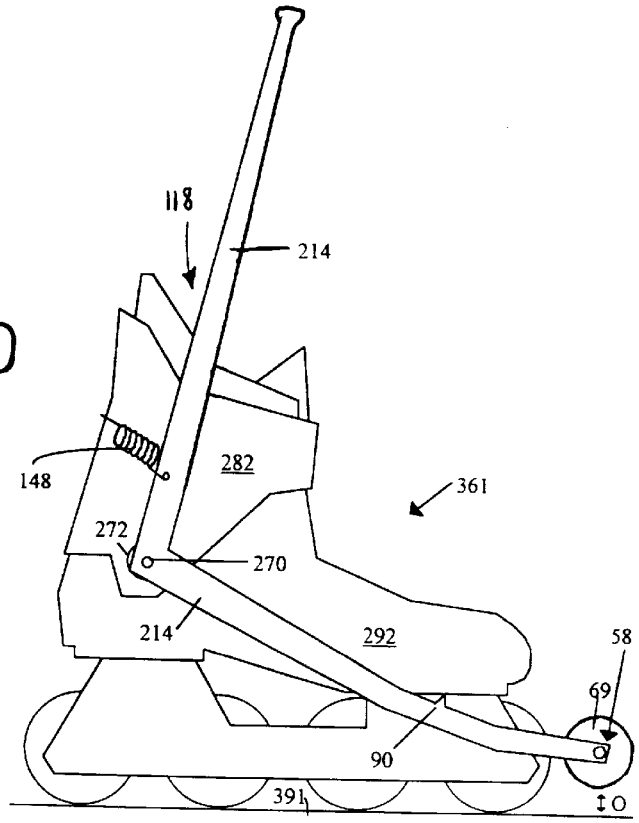
FIGS. 30 and 31 are side views of frontal brake devices manufactured on a skate.

FIG. 30 shows a brake assembly 118 of which is manufactured onto a skate at a pivotally mounted rivet point 272 where a rod 214 is connected behind a rivet extension 270. The brake is activated by pushing the rod forward, rather than downwards. The spring is attached in a hole on the rod and connects to the skate cuff or any other predetermined or sufficient place on the skate. Recess 90 keeps the rod from retracting too far upwards.

Figure 31:
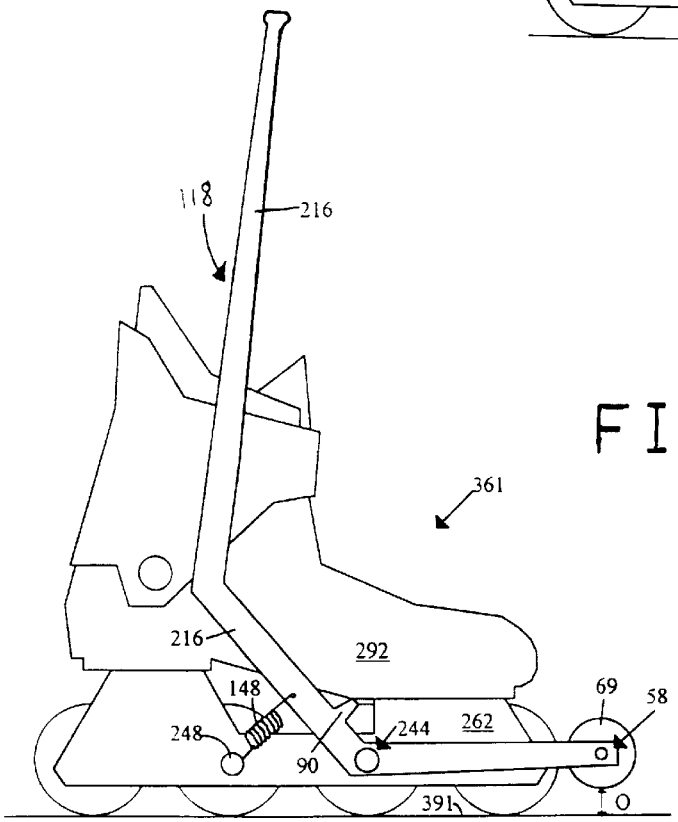

FIG. 31 shows the brake assembly 118 mounted to a skate at a retrofitted and pivoting axle point 244. The spring is attached from the rod to the axle nut 248 and serves to retract the brake assembly backwards. Rods 214 and 216 are bent outwardly around recess points 90 to fit alongside the skates.

CONCLUSION, RAMIFICATIONS, AND SCOPE

Accordingly, the reader will see that the hand-activated brake assembly can be used to stop a pair of skates safely, easily and effectively.

Although the description above contains many specifications, these should not be construed as limiting the scope of the hand-activated brake but as merely providing illustrations of some of the presently preferred embodiments of this hand-activated brake.

For example, the brake pads can have other shapes and forms; the brake pads can be made out of many materials such as rubber, plastic, etc.; the rods can be circular, hollow, square, etc.; the handle can be omitted or can be any shape or form as to provide a device for grasping; the brake pads can be placed in many locations and angles; the spring can be replaced by any other device for allowing the brake to retract and can be mounted in any operable location; the brake pad can be attached to a single rod, deleting any adjustment parts, pivot assemblies, etc.

Additionally, the brake assembly can be made in the simplest way possible while still operable by hand. For example the entire invention of all drawing figures can be as simple as a single rod attached to a brake pad or a brake pad mounting device, so long as the brake pad is operatively mounted anywhere predetermined on skates. Many parts may be deleted for simplicity such as the handle, strap assembly, adjustment systems, nuts, bolts, washers, bearings pivots, spacers, etc.

The invention having been disclosed, a number of additional uses and variations will now be apparent to those skilled in the art. Whereas the invention is intended to encompass the foregoing preferred and alternative embodiments as well as a reasonable range of equivalents, reference should be made to the appended claims rather than the foregoing discussion of examples, in order to assess the scope of the invention in which exclusive rights are claimed. Thus the scope of the hand-activated brake should also be determined by the appended claims and their legal equivalents, rather than by the examples given.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A secondary hand-activated brake assembly for attachment to a skate having an additional brake, the assembly comprising: a rigid rod device for manual actuation, wherein the rod device is operatively mounted to actuate a ground-engaging brake pad, whereby said ground-engaging brake pad is operatively mounted upon a brake pad frame having a first pivotal end, said first pivotal end having a pivotal axis for attachment coincident with a wheel axle of the skate, said brake pad frame further comprising a second pivotal end attached to said rod device, and an elastic device operatively mounted to said brake assembly at said second pivotal end for retracting said brake assembly, whereby when said brake assembly is activated, said rod device pivots freely, said brake pad frame pivots freely and said rod device is intended to be secured to a user's leg whereby when said brake assembly is retrofitted or manufactured onto said skate, said skate can be slowed and stopped when a user applies hand pressure to said rod device, resulting in said rod device pushing said ground-engaging brake pad to an operative position.

2. The brake assembly of claim 1, further including a means for operatively mounting said brake assembly to a foot-mounted wheeled vehicle, wherein said brake pad frictionally engages upon one or more of said vehicle's wheels.

3. The brake assembly of claim 1, wherein said rod device further includes an adjustment means for changing the length of said rod device.

4. The brake assembly of claim 1, further including an in-line skate, said in-line skate comprising a shoe, a wheel frame, and a plurality of wheels arranged in a relatively straight line, whereby said secondary brake assembly is appropriately manufactured onto said in-line skate.

5. The brake assembly of claim 1, further including a leg strap assembly comprising:

(a) a piece of elastic or expandable material with a fastener or VELCRO securely mounted or sewn on said material, and (b) a cushion pad securely mounted to a predetermined location of said elastic; whereby when said strap assembly is utilized with said rod device said rod device, remains secured to a user's leg.

6. A method for providing a secondary hand activated rod brake assembly to be retrofitted or manufactured onto a cuff-activated brake assembly having a brake pad and provided on a foot-mounted roller skate, the method comprising the steps of:

(a) mounting a hand-activated rigid rod to a section of said cuff-activated brake assembly, (b) providing a second brake pad mounted to a brake pad frame having a first pivotal end, said first pivotal end having a pivotal axis for attachment coincident with a wheel axle of the skate, said brake pad frame further comprising a second pivotal end attached to said rigid rod, and (c) mounting a retraction means to said second brake pad for retracting said second brake pad, whereby said cuff-activated brake assembly is transformed from a cuff-activated brake assembly to a hand-activated brake assembly.

7. The method of claim 6, wherein said cuff-activated brake assembly comprises a brake assembly intended to brake one or more wheels of said roller skate on any skating surface.

8. The method of claim 6, further including providing a strap assembly comprising:

(a) a piece of elastic with a fastener securely mounted on said elastic;

(b) a cushion pad securely mounted to a predetermined location of said elastic, whereby when said strap assembly is utilized with said rod, said rod device remains secured to a user's leg.

* * * * *